US010138878B2

(12) United States Patent
Chou

(10) Patent No.: US 10,138,878 B2
(45) Date of Patent: Nov. 27, 2018

(54) AIR COMPRESSOR

(71) Applicant: Wen-San Chou, Tainan (TW)

(72) Inventor: Wen-San Chou, Tainan (TW)

( * ) Notice: Subject to any disclaimer, the term of this patent is extended or adjusted under 35 U.S.C. 154(b) by 165 days.

(21) Appl. No.: 15/438,564

(22) Filed: Feb. 21, 2017

(65) Prior Publication Data

US 2017/0248132 A1 Aug. 31, 2017

(30) Foreign Application Priority Data

Feb. 26, 2016 (TW) ..... 105106034 A

(51) Int. Cl.

| | |
|---|---|
| ***F04B 39/10*** | (2006.01) |
| ***F04B 53/10*** | (2006.01) |
| ***F04B 39/12*** | (2006.01) |
| ***F04B 39/08*** | (2006.01) |
| ***F04B 35/04*** | (2006.01) |

(52) U.S. Cl.

CPC ..... *F04B 39/10* (2013.01); *F04B 35/04* (2013.01); *F04B 39/08* (2013.01); *F04B 39/108* (2013.01); *F04B 39/1066* (2013.01); *F04B 39/1073* (2013.01); *F04B 39/123* (2013.01); *F04B 39/125* (2013.01); *F04B 53/10* (2013.01); *F04B 53/1055* (2013.01)

(58) Field of Classification Search

CPC ..... F04B 35/04; F04B 39/121; F04B 49/22; F04B 39/125; F04B 39/14; F04B 39/1073; F04B 39/122

See application file for complete search history.

(56) References Cited

U.S. PATENT DOCUMENTS

| | | | | |
|---|---|---|---|---|
| 9,759,207 | B2 * | 9/2017 | Chou | F04B 35/04 |
| 2007/0212242 | A1 * | 9/2007 | Chen | F04B 39/1066 417/571 |
| 2008/0145245 | A1 * | 6/2008 | Chou | B29C 73/166 417/415 |
| 2009/0028733 | A1 * | 1/2009 | Duwel | F04B 39/1066 417/546 |
| 2012/0121443 | A1 * | 5/2012 | Chou | F04B 35/04 417/297 |
| 2013/0011283 | A1 * | 1/2013 | Chou | F04B 35/04 417/437 |
| 2014/0112812 | A1 * | 4/2014 | Takemi | F04B 39/121 417/571 |
| 2015/0316044 | A1 * | 11/2015 | Lifson | F04B 27/1009 417/437 |
| 2017/0204844 | A1 * | 7/2017 | Chou | F04B 39/125 |

* cited by examiner

*Primary Examiner* — Dominick L Plakkoottam

(57) ABSTRACT

An improved air compressor includes a cylinder fitted with a piston body, a main frame for mounting a motor, and an air storage container. The cylinder defines at its top wall a plurality of exit holes, which are separated by a plurality of blocking walls and regulated by a resilient sheet having a plurality of branches corresponding to the exit holes. When the compressed air produced in the cylinder pushes the resilient sheet up to open the exit holes, the instantaneous high-pressure air that flows through the exit holes can be restrained by the air blocking walls to prevent the air from interfering with movements of the branches of the resilient sheet, so that the piston body can conduct reciprocating motion more smoothly and thus the performance of the air compressor can be increased.

13 Claims, 16 Drawing Sheets

AIR COMPRESSOR

TECHNICAL FIELD OF THE INVENTION

The present invention relates to an air compressor and, more particularly, to an improved air compressor, wherein a cylinder thereof is fitted with a piston body and defines a plurality of exit holes at its top wall and is provided at its top wall with a plurality of air blocking walls, which can isolate the exit holes from each other at a certain extent, and the exit holes are regulated by a resilient sheet to be opened or closed, the resilient sheet having a root and a plurality of branches extending from the root and corresponding to the exit holes, whereby the piston body can conduct reciprocating motion more smoothly and thus the performance of the air compressor can be increased.

DESCRIPTION OF THE PRIOR ART

Generally, an air compressor has a cylinder which allows a piston body to conduct reciprocating motion therein to produce compressed air which can overcome a valve mechanism, so that the compressed air can flow through an exit hole of the cylinder to enter the inner space of an air storage container or an air tank. The air storage container is provided with outlets for delivering the compressed air to an object to be inflated.

In conventional air compressors, there is only one exit hole defined at the cylinder for outputting the compressed air into the air storage container. The exit hole of the cylinder is controlled by a valve mechanism, which generally includes a plug and a compression spring, so that the exit hole can be opened or closed properly according to the pressure of the compressed air. In operation, the compressed air produced in the cylinder can overcome the compressive force of the compression spring to enter the inner space of the air compressor. However, the compressed air stored in the air storage container can exert a back force on the plug, thus restraining the plug from being moved away from the exit hole. As a result, the piston body, which conducts reciprocating motion in relation to the cylinder, will be subjected to greater resistance. Therefore, the piston body may not move smoothly in relation to the cylinder, and thus the speed of inflating an object may decrease. Furthermore, the motor of the air compressor may become too hot, thus decreasing the performance of the motor. Even worse, the motor may be under the risk of burning out.

In view of the foregoing, the applicant intends to develop an improved air compressor which can solve the shortcomings of conventional air compressors.

SUMMARY OF THE INVENTION

One object of the present invention is to provide an air compressor, wherein a cylinder thereof is fitted with a piston body and defines at its top wall a plurality of exit holes, and is provided at its top wall with a plurality of air blocking walls, which can isolate the exit holes from each other at a certain extent, and the exit holes are regulated by a control mechanism to be opened or closed; the control mechanism includes a resilient sheet having a root and a plurality of branches extending from the root and corresponding to the exit holes; whereby when the compressed air produced in the cylinder pushes the branches of the resilient sheet up to open the exit holes, the instantaneous high-pressure air that flows through the exit holes can be restrained by the air blocking walls to prevent the air from interfering with movements of the branches of the resilient sheet, so that the piston body can conduct reciprocating motion more smoothly and thus the performance of the air compressor can be increased.

According to one aspect of the present invention, the root and the branches of the resilient sheet are individually attached to the top wall of the cylinder at separate fixed points, whereby each of the branches of the resilient sheet can be moved individually by the compressed air without affecting movements of the other branches, so that the piston body can conduct reciprocating motion more smoothly, and thus the performance of the air compressor and the speed of inflating an object can be increased.

Other objects, advantages, and novel features of the present invention will become more apparent from the following detailed description when taken in conjunction with the accompanying drawings.

DETAILED DESCRIPTION OF THE PREFERRED EMBODIMENTS

Figure 1:
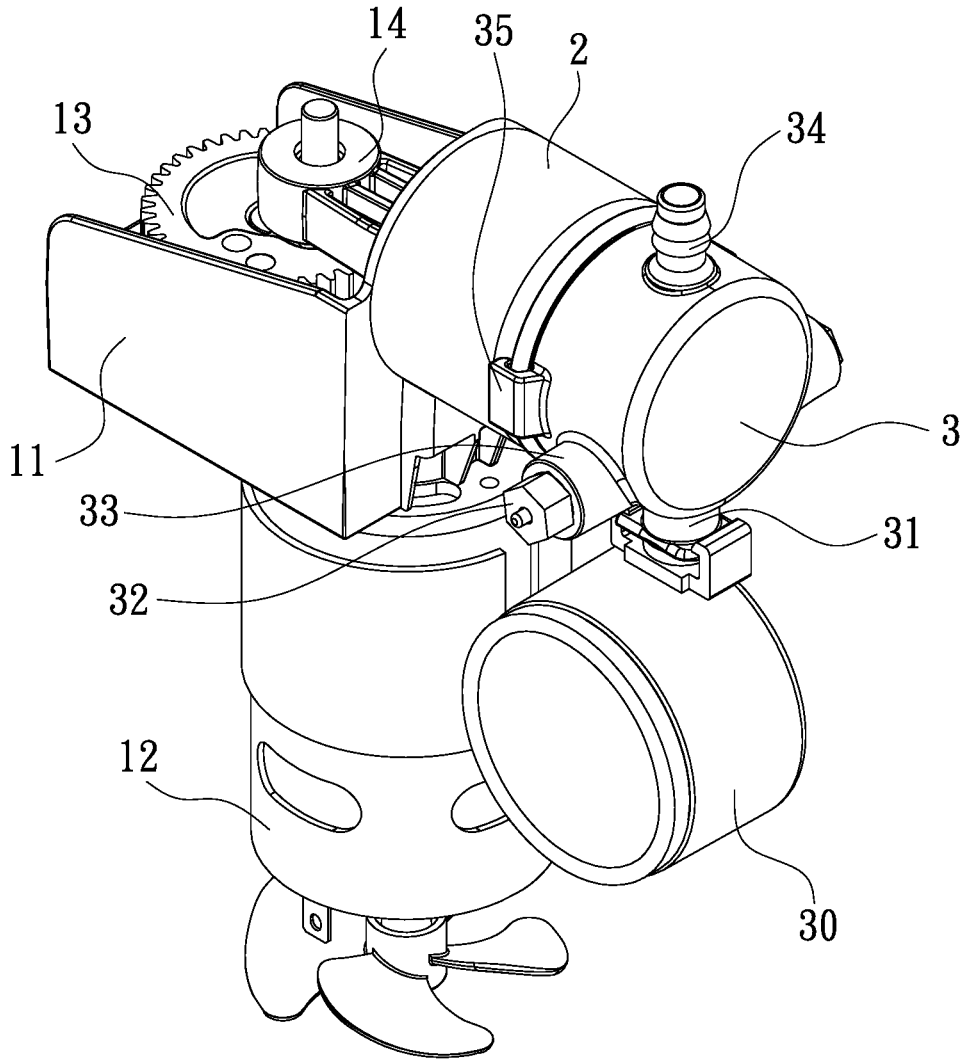
FIG. 1 shows a 3-dimensional view of an air compressor according to a first embodiment of the present invention.
Figure 2:
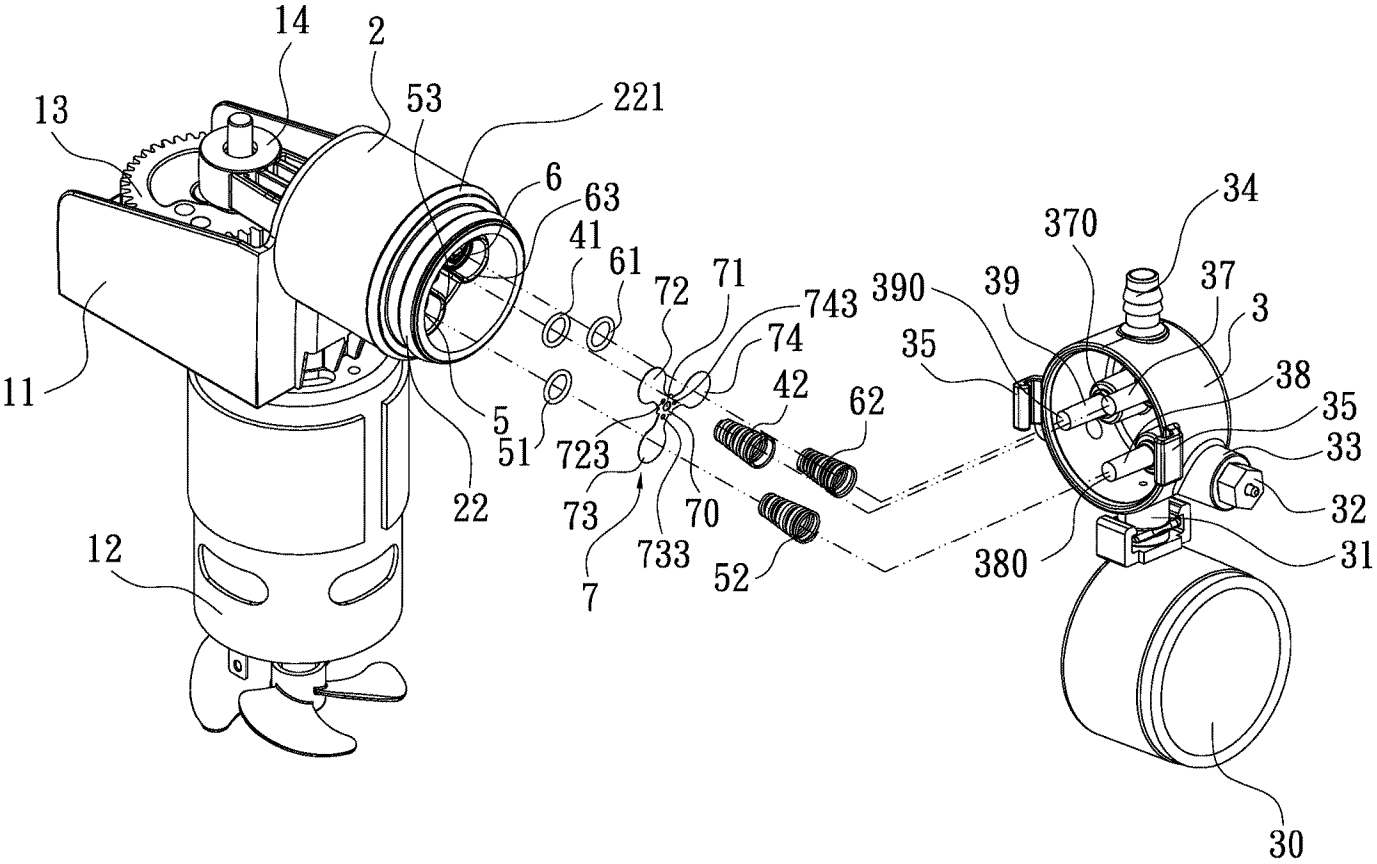
FIG. 2 shows an exploded view of the air compressor of the first embodiment.

Referring to FIGS. 1 and 2, an improved air compressor according to a first embodiment of the present invention is shown, which generally comprises a main frame 11 for mounting a motor 12, and a cylinder 2 fitted with a piston body 14. The motor 12 can rotate a gear 13 to drive the piston body 14 to conduct reciprocating motion in relation to the cylinder 2 so as to produce compressed air, which can enter an air storage container 3 provided with one or more outlets, wherein, for example, the outlet 31 can be connected with a pressure gauge 30; the outlet 33 can be connected with a relief valve 32; the outlet 34 can be connected with a hose for inflating an object (not shown).

As shown in FIGS. 2 through 8, the cylinder 2 of the present invention is designed in a way different from conventional technology, wherein the cylinder 2 defines a plurality of exit holes and a plurality of air blocking walls at an interface thereof, which refers to the top wall 21 in the present invention. Through the exit holes, the compressed air produced in the cylinder can be outputted to a container or tank. Furthermore, the cylinder 2, which includes the exit holes and the air blocking walls, can be formed integrally with the main frame 11. In this embodiment, three exit holes 4, 5, 6 are defined at the top wall 21, and three cylindrical air blocking walls 43, 53, 63 are formed at the top wall 21 and surround the exit holes 4, 5, 6, respectively. The air blocking walls 43, 53, 63 respectively define openings 431, 531, 631, which face a central axis of the cylinder 2. The exit holes 4, 5, 6 are regulated by a control mechanism to be opened or closed, wherein the control mechanism includes O-rings 41, 51, 61, compression springs 42, 52, 62, and a resilient sheet 7. The O-rings 41, 51, 61 can be placed around the exit holes 4, 5, 6, respectively. The resilient sheet 7 has a root 70 and three branches including a first branch 72, a second branch 73, and a third branch 74, which correspond to the exit holes 4, 5, 6 respectively. The root 70 of the resilient sheet 7, which is substantially located at a center of the resilient sheet 7, defines a central positioning hole 71. The three branches 72, 73, 74 extend from the root 70 to appear as a star configuration. The first branch 72 has a first neck portion 722 extending from the root 70 and terminating at a first leaf 721, and defines a first positioning hole 723 at one end of the first neck portion 722 close to the root 70. The second branch 73 has a second neck portion 732 extending from the root 70 and terminating at a second leaf 731, and defines a second positioning hole 733 at one end of the second neck portion 732 close to the root 70. The third branch 74 has a third neck portion 742 extending from the root 70 and terminating at a third leaf 741, and defines a third positioning hole 743 at one end of the third neck portion 742 close to the root 70. The central positioning hole 71 of the root 70 can be fitted over a main boss 24 provided at the top wall 21 of the cylinder 2, wherein the main boss 24 is located at a central point (P). The first positioning hole 723 of the first branch 72 can be fitted over a first boss 241 provided at the top wall 21 of the cylinder 2, wherein the first boss 241 is located at a peripheral point (P1) close to the central point (P). The second positioning hole 733 of the second branch 73 can be fitted over a second boss 242 provided at the top wall 21 of the cylinder 2, wherein the second boss 242 is located at a peripheral point (P2) close to the central point (P). The third positioning hole 743 of the third branch 74 can be fitted over a third boss 243 provided at the top wall 21 of the cylinder 2, wherein the third boss 243 is located at a peripheral point (P3) close to the central point (P). The peripheral points (P1, P2, P3) are individual and separate from the central point (P); namely, there is a distance between each of the peripheral points (P1, P2, P3) and the central point (P). The first branch 72, the second branch 73, and the third branch 74 are attached to the top wall 21, respectively at the peripheral points (P1, P2, P3). As shown in HG 4, the first neck portion 722 of the first branch 72, the second neck portion 732 of the second branch 73, and the third neck portion 742 of the third branch 74 are respectively fitted through the openings 431, 531, 631 of the air blocking walls 43, 53, 63, wherein the first leaf 721 of the first branch 72, the second leaf 731 of the second branch 73, and the third leaf 741 of the third branch 74 are located within the air blocking walls 43, 53, 63 and in tight contact with the O-rings 41, 51, 61 to seal the exit holes 4, 5, 6, respectively. The first, second and third leaves 721, 731, 741 are configured to have sizes sufficient for covering the exit holes 4, 5, 6. Each of the compression springs 42, 52, 62 has one end in contact with one of the branches 72, 73, 74 of the resilient sheet 7 (see FIGS. 2, 6 and 7). The cylinder 2 has a tubular projection 22 formed on the top wall 21. The tubular projection 22 is provided at its outer surface with a circular flange 221 and defines an annular groove 222 between the circular flange 221 and the top wall 21 (see HG 8). The air storage container 3 is provided at an outer surface thereof with two coupling means 35 capable of being inserted into the annular groove 222 and engaged with the circular flange 221 of the cylinder 2. The air storage container 3 is provided at an inner surface thereof with a plurality of columns 37, 38, 39 corresponding to the branches 72, 73, 74 of the resilient sheet 7. Each of the column 37, 38, 39 is formed at its distal end with a limiting surface 370, 380 or 390, which is at a predetermined angle (Θ) to the top wall 21 (Θ>0)(see FIG. 6); namely, the distal ends of the columns 37, 38, 39 are not parallel to the top wall 21. Each of the compression springs 42, 52, 62 has another end being fitted at the distal end of one of the columns 37, 38, 39. The compressive forces of the compression springs 42, 52, 62 enable the branches 72, 73, 74 of the resilient sheet 7 to seal the exit holes 4, 5, 6 respectively. Each of the columns 37, 38, 39 is located at a predetermined height above the corresponding branch of the resilient sheet 7 to limit the movement of the corresponding branch so that the resilient sheet 7 can be prevented from elastic fatigue. In particular, when the first, second and third branches 72, 73, 74 are pushed by the compressed air to move away from the exit holes 4, 5, 6, due to the branches 72, 73, 74 being in full surface contact with the limiting surfaces 370, 380, 390 of the columns 37, 38, 39, the first, second and third branches 72, 73, 74 can conduct the closing or opening operation more stably.

Figure 3:
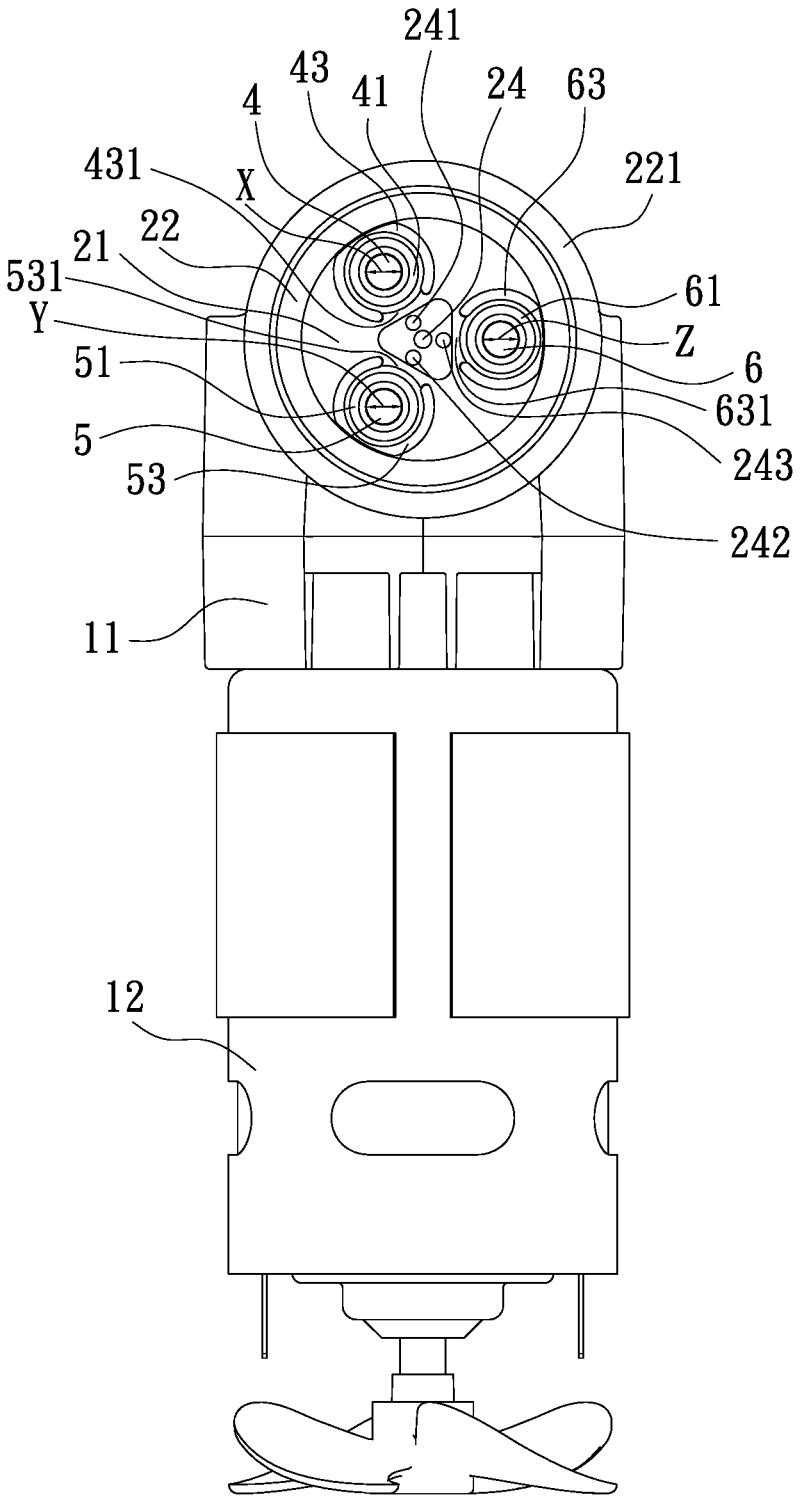
FIG. 3 shows a plan view of the air compressor of the first embodiment, wherein a plurality of exit holes defined at a cylinder thereof are revealed.
Figure 4:
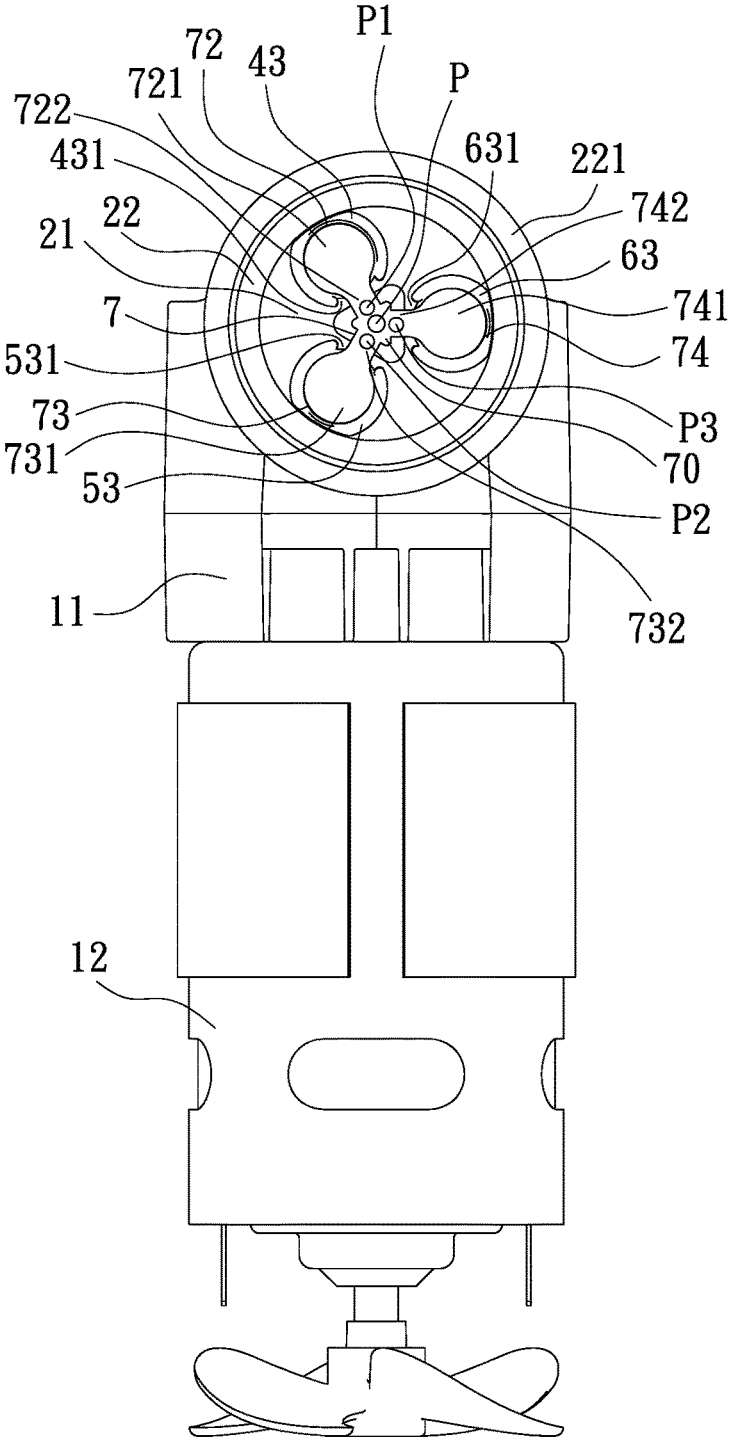
FIG. 4 shows a plan view of the air compressor of the first embodiment, wherein a resilient sheet being used to seal the exit holes is revealed.
Figure 5:
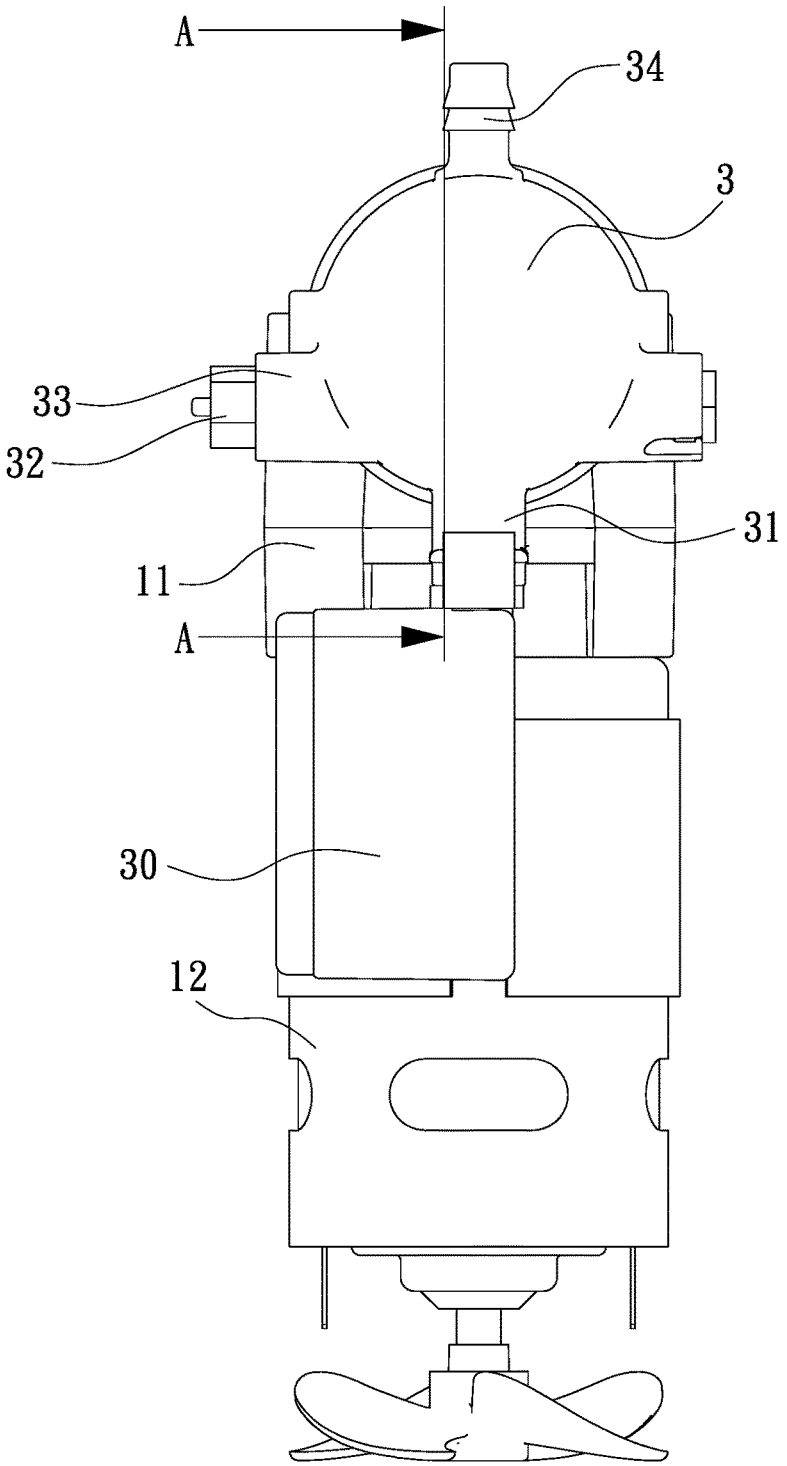
FIG. 5 shows a plan view of the air compressor of the first embodiment, wherein an air storage container is assembled onto the cylinder.

The exit hole 4 is defined to have a diameter of (X); the exit hole 5 is defined to have a diameter of (Y); the exit hole 7 is defined to have a diameter of (Z). As shown in FIG. 3, the exit holes 4, 5, 6 are equal in diameter; however, this is not a limitation for the structure of the exit holes. The exit holes may be defined to have different diameters.

Figure 6:
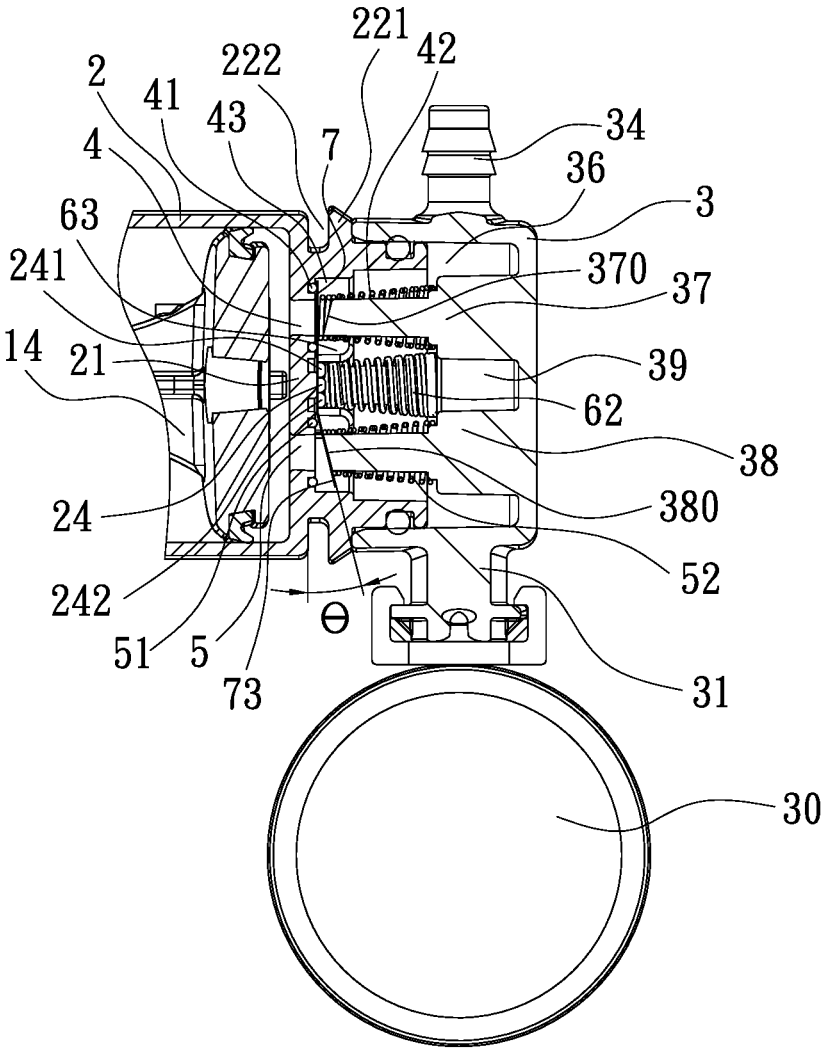
FIG. 6 shows a sectional view of the air compressor of the first embodiment taken along line A-A in FIG. 5.
Figure 7:
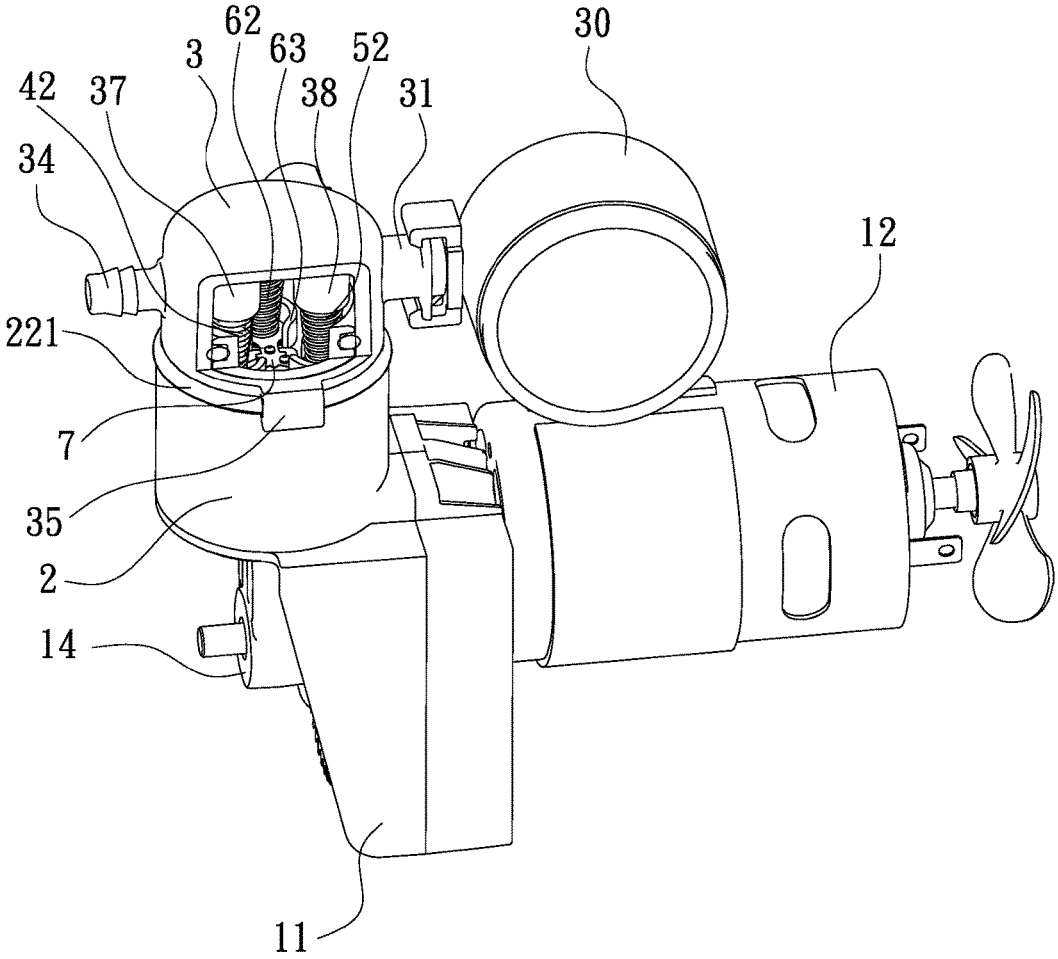
FIG. 7 shows a 3-dimensional sectional view of the air compressor of the first embodiment.
Figure 8:
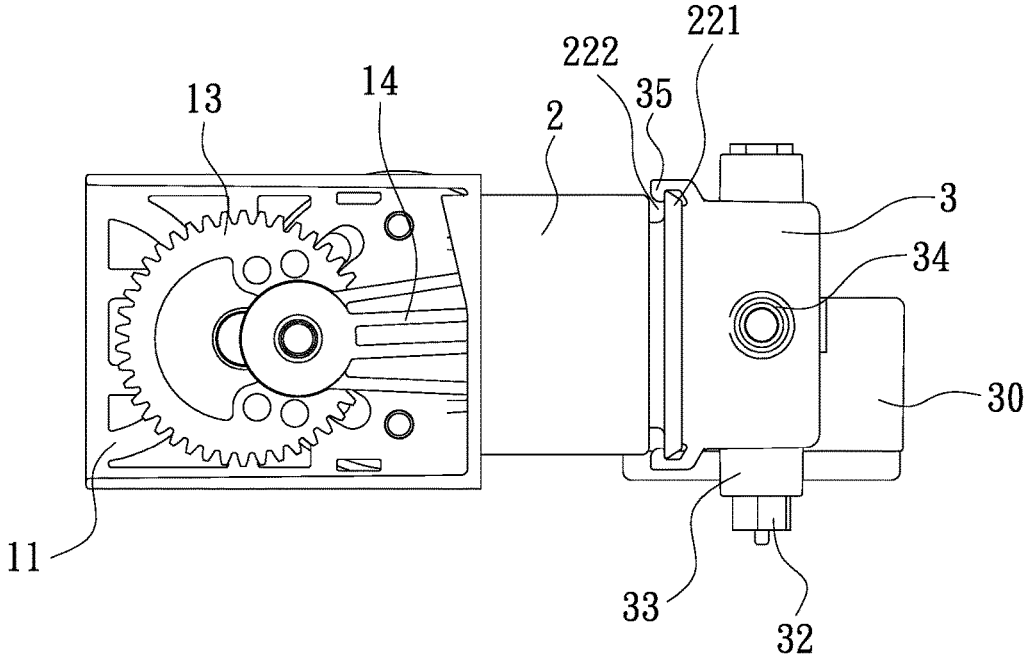
FIG. 8 shows a plan view of the air compressor of the first embodiment, wherein a gear and a piston body used in the air compressor are revealed.

Referring to FIGS. 6 and 7, when the piston body 14 conducts reciprocating motion, the compressed air produced in the cylinder 2 can overcome the force of the compression springs 42, 52, 62 exerted on the branches 72, 73, 74 of the resilient sheet 7, thus pushing the branches 72, 73, 74 to move away from the equal-diameter exit holes 4, 5, 6, respectively, so that the compressed air can flow into the inner space 36 of the air storage container 3. Initially, since the compressed air can flow into the inner space 36 of the air storage container 3 simultaneously via the exit holes 4, 5, 6, the air storage container 3 can be filled with a large amount of air in a short time. Later, since there is a large amount of air having entered the inner space 36 of the air storage container 3, the air contained in the air storage container 3 can exert a greater back force on the branches 72, 73, 74 of the resilient sheet 7 compared to the initial air contained in the air storage container 3. In other words, the piston body 14 may experience greater resistance in conducting reciprocating motion, and this may cause the exit holes 4, 5, 6 more difficult to be opened. However, upon a decrease of the pressure of the air contained in the air storage container 3, the back force exerted on the branches 72, 73, 74 of the resilient sheet 7 will decrease and this allows the compressed air produced in the cylinder 2 to quickly enter the inner space 36 of the air storage container 3. Besides, the first neck portion 722, the second neck portion 732, and the third neck portion 742 are attached to the top wall 21 of the cylinder 2 at separate fixed points. The air blocking walls 43, 53, 63 can respectively confine the first leaf 721 of the first branch 72, the second leaf 731 of the branch 73, and the third leaf 741 of the third branch 74 therein, and are configured to have predetermined heights greater than maximum distances that the branches 72, 73, 74 of the resilient sheet 7 can be pushed up by the compressed air to travel, so that the air blocking walls 43, 53, 63 can restrain the instantaneous high-pressure air that flows through the exit holes 4, 5, 6, thus preventing the air from interfering with movements of the branches 72, 73, 74 of the resilient sheet 7, so that the piston body 14 can conduct reciprocating motion more smoothly and thus the performance of the air compressor and the speed of inflating an object can be increased.

FIGS. 9 through 15 show a second embodiment of the present invention, wherein the air blocking walls 44, 54, 64 are planar walls, each planar wall being located between two adjacent exit holes and extending from the tubular projection 22 towards a central axis of the cylinder 2, thus defining a plurality of gaps 441, 541, 641 between the planar walls 44, 54, 64, so that the exit holes 4, 5, 6 can be isolated from each other at a certain extent. The gaps 441, 541, 641 allow the branches 72, 73, 74 of the resilient sheet 7 to be fitted over the exit holes 4, 5, 6, so that the branches 72, 73, 74 can be disposed in tight contact with the O-rings 41, 51, 61 to seal the exit holes 4, 5, 6, respectively (see FIG. 11).

In the second embodiment of the present invention, the air storage container 3 is provided at an inner surface thereof with a plurality of hollow columns 371, 381, 391 corresponding to the branches 72, 73, 74 of the resilient sheet 7. Each of the hollow columns 371, 381, 391 is formed at its distal end with a limiting surface 372, 382 or 392 (see FIGS. 13 through 15), which is at a predetermined angle (Θ1) to the top wall 21 (Θ1>0); namely, the limiting surfaces 372, 382, 392 are not parallel to the top wall 21. Being similar to the first embodiment, the air storage container 3 is provided at an outer surface thereof with two coupling means 35 capable of being inserted into the annular groove 222 and engaged with the circular flange 221 of the cylinder 2. Each of the compression springs 42, 52, 62 has one end forcing against one of the branches of the resilient sheet 7, and has another end being fitted into the distal end of one of the hollow columns 371, 381, 391. The compressive forces of the compression springs 42, 52, 62 enable the branches 72, 73, 74 of the resilient sheet 7 to seal the exit holes 4, 5, 6, respectively; wherein each of the hollow columns 371, 381, 391 is located at a predetermined height above the corresponding branch of the resilient sheet 7 to limit the movement of the corresponding branch so that the resilient sheet 7 can be prevented from elastic fatigue. In particular, when the branches 72, 73, 74 are pushed by the compressed air to move away from the exit holes 4, 5, 6, due to the branches 72, 73, 74 being in full surface contact with the limiting surfaces 372, 382, 392 of the hollow columns 371, 381, 391, the branches of the resilient sheet can conduct the closing or opening operation more stably.

Figure 9:
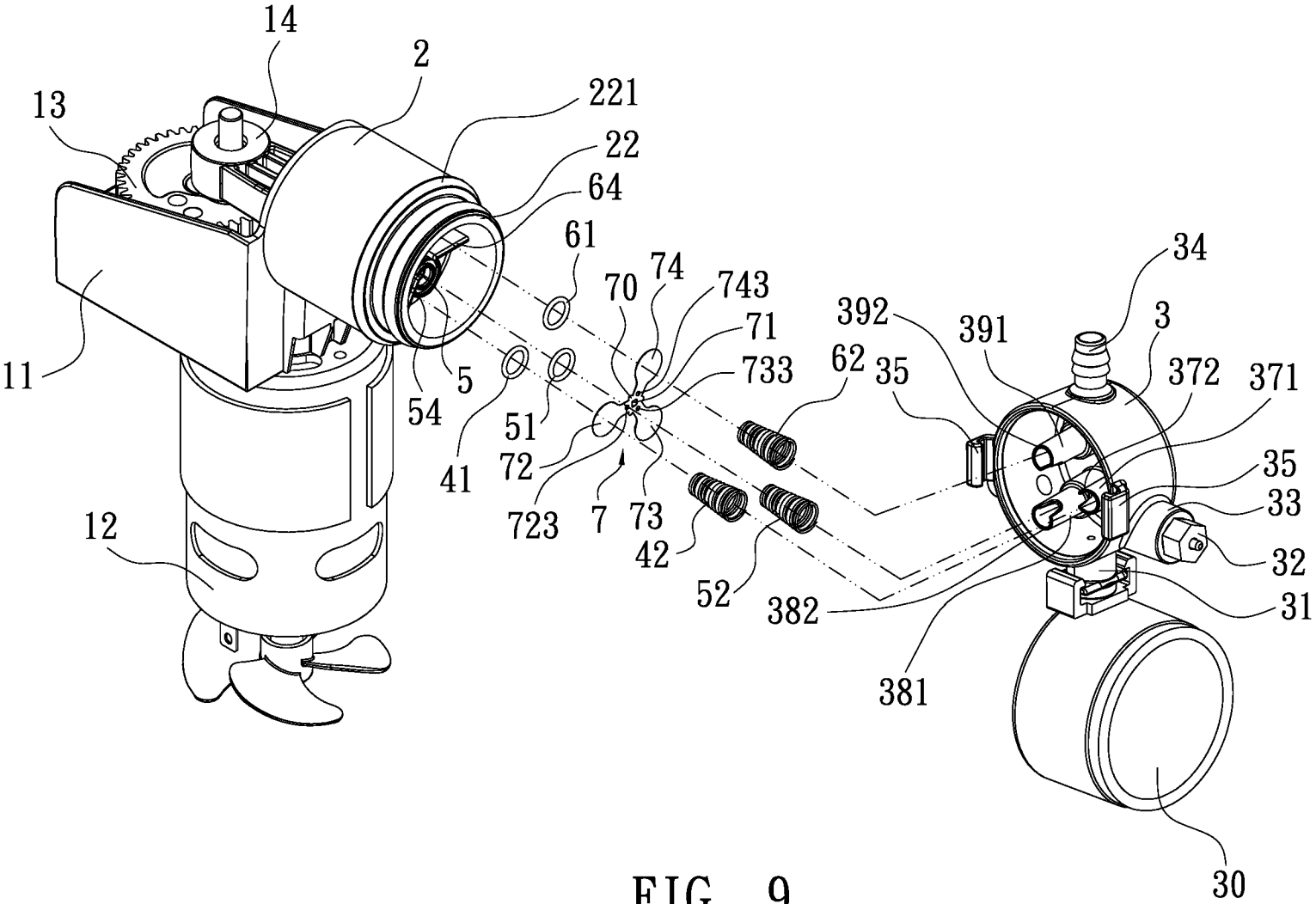
FIG. 9 shows a 3-dimensional view of an air compressor according to a second embodiment of the present invention.
Figure 10:
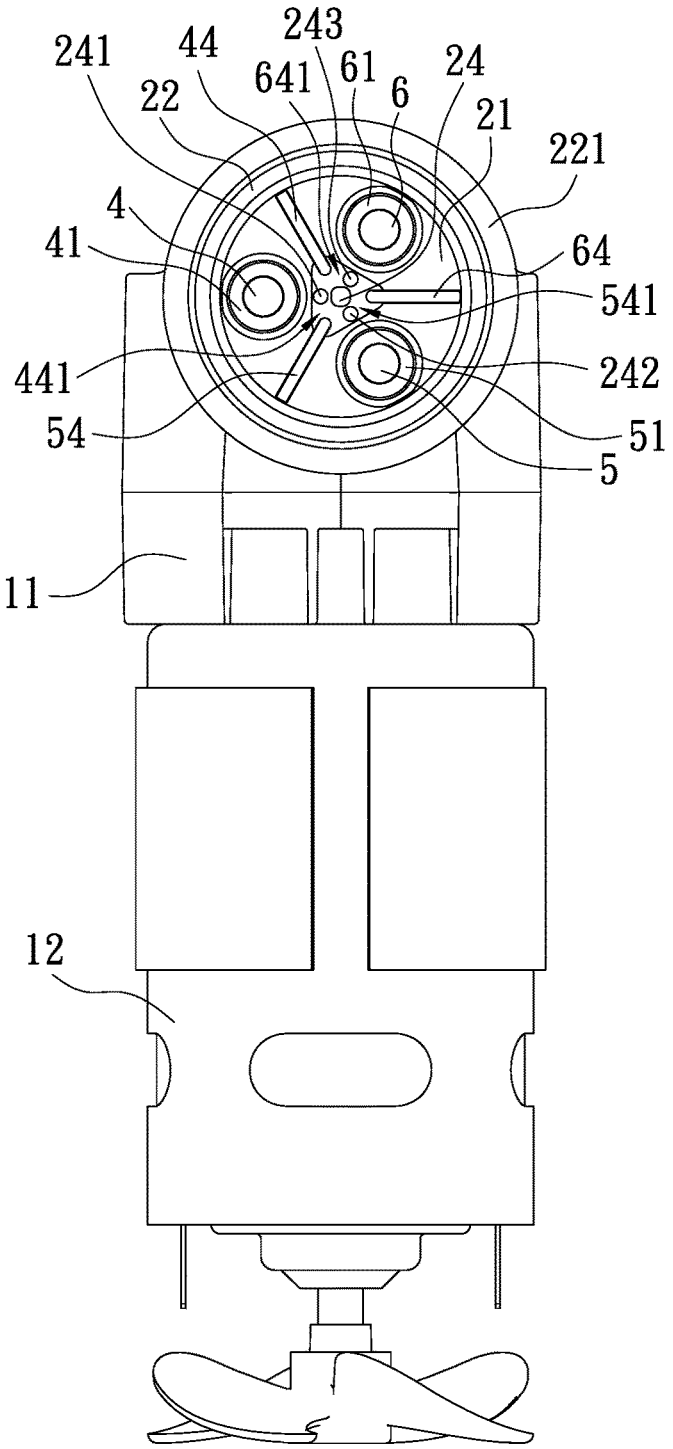
FIG. 10 shows a plan view of the air compressor of the second embodiment, wherein a plurality of exit holes defined at a cylinder thereof are revealed.
Figure 11:
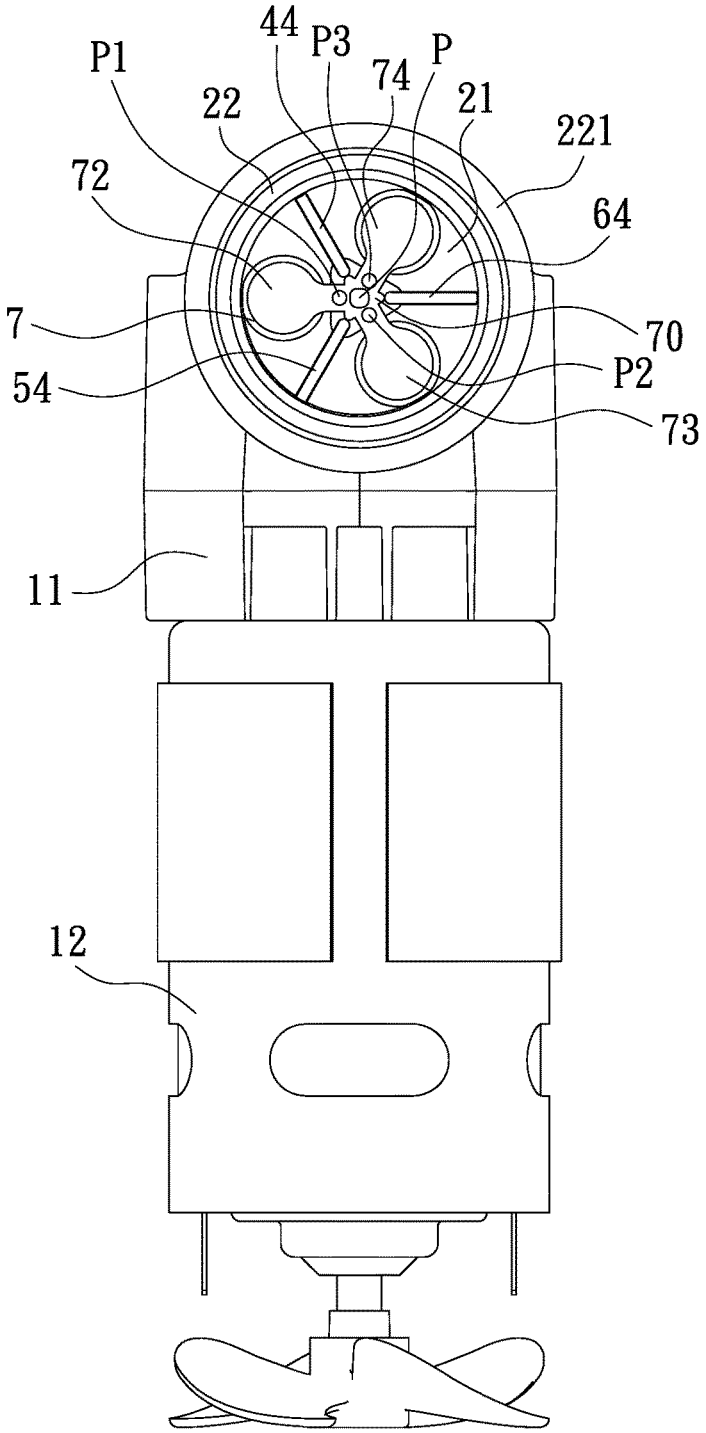
FIG. 11 shows a plan view of the air compressor of the second embodiment, wherein a resilient sheet being used to seal the exit holes is revealed.
Figure 12:
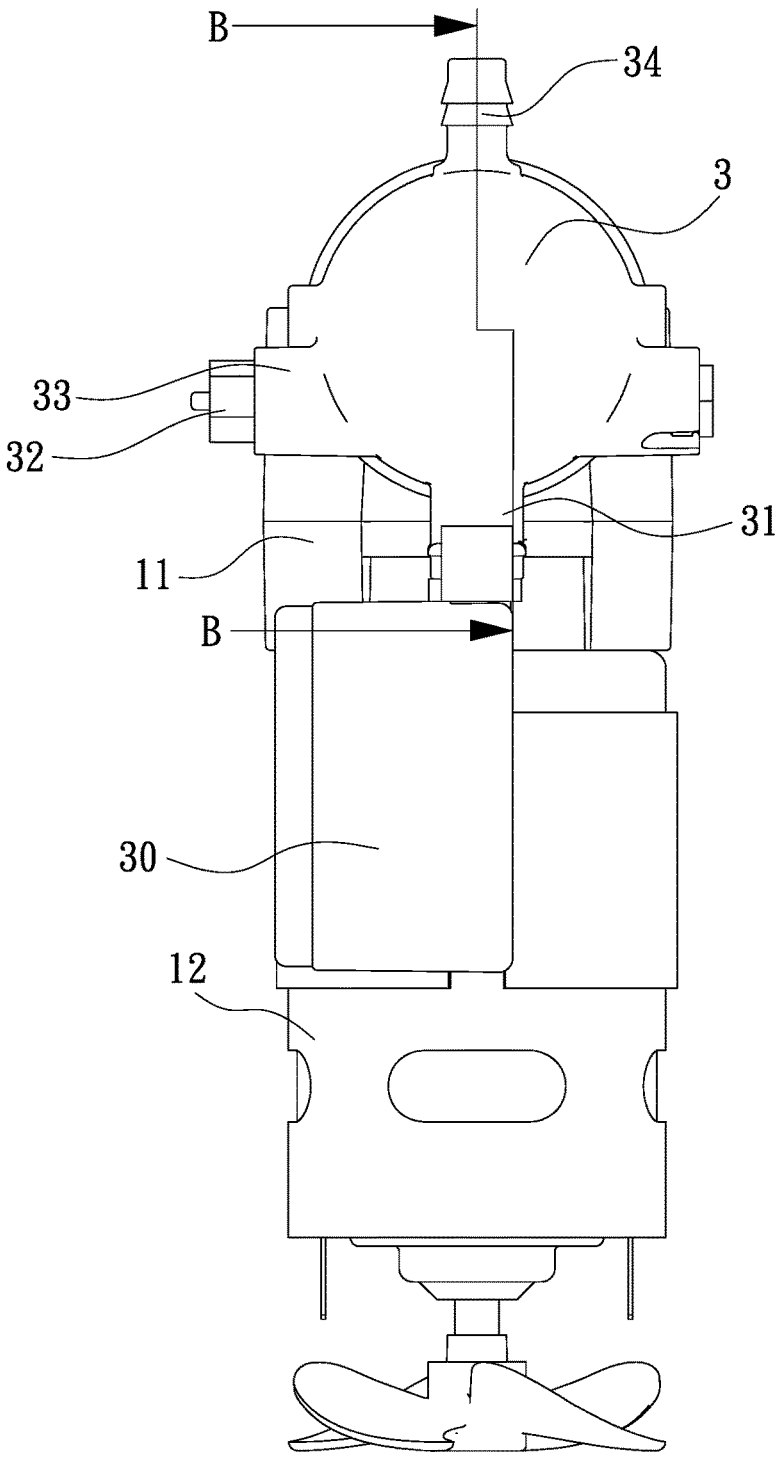
FIG. 12 shows a plan view of the air compressor of the second embodiment, wherein an air storage container is assembled onto the cylinder
Figure 13:
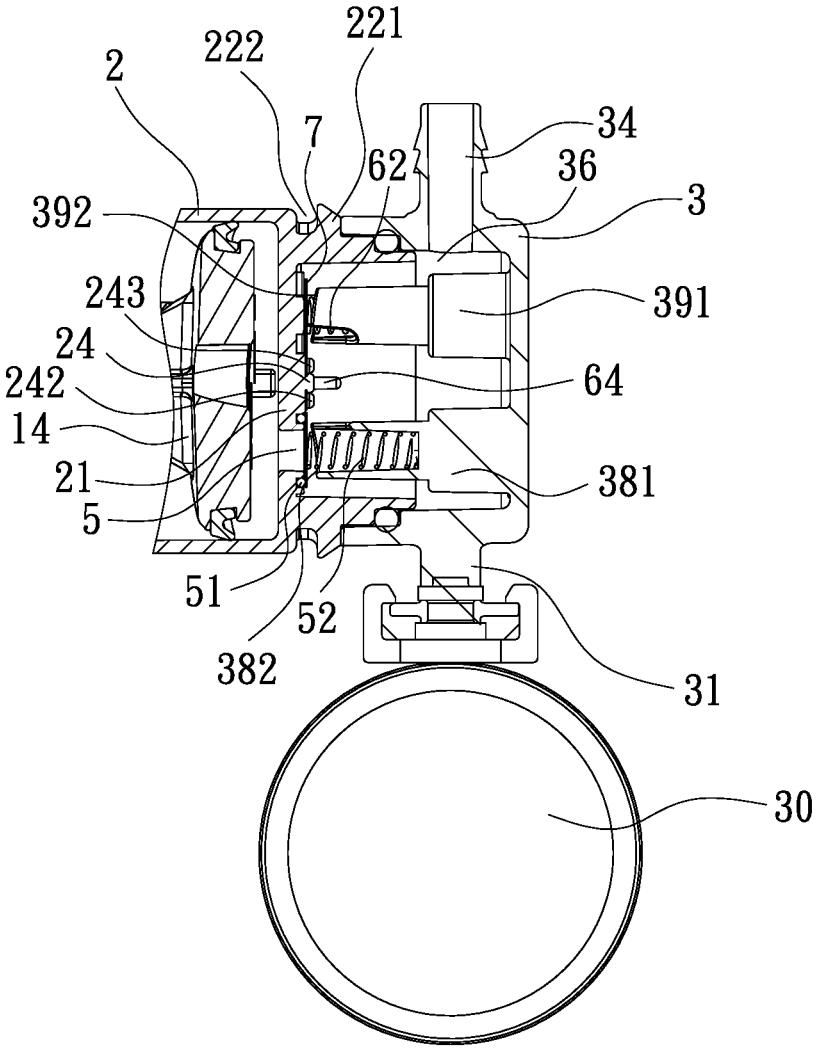
FIG. 13 shows a sectional view of the air compressor of the second embodiment taken along line B-B in FIG. 12, wherein the resilient sheet is sealing the exit holes.
Figure 14:
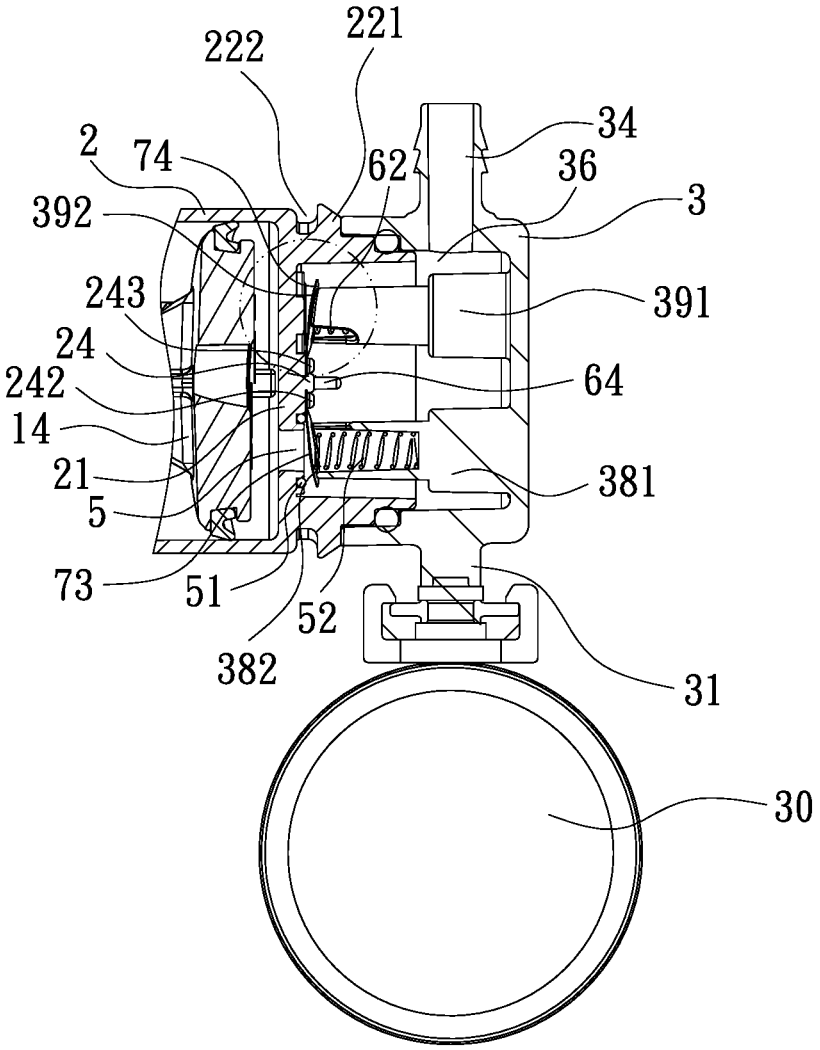
FIG. 14 shows a sectional view of the air compressor of the second embodiment taken along line B-B in FIG. 12, wherein the branches of the resilient sheet are pushed up by the compressed air in the cylinder.
Figure 15:
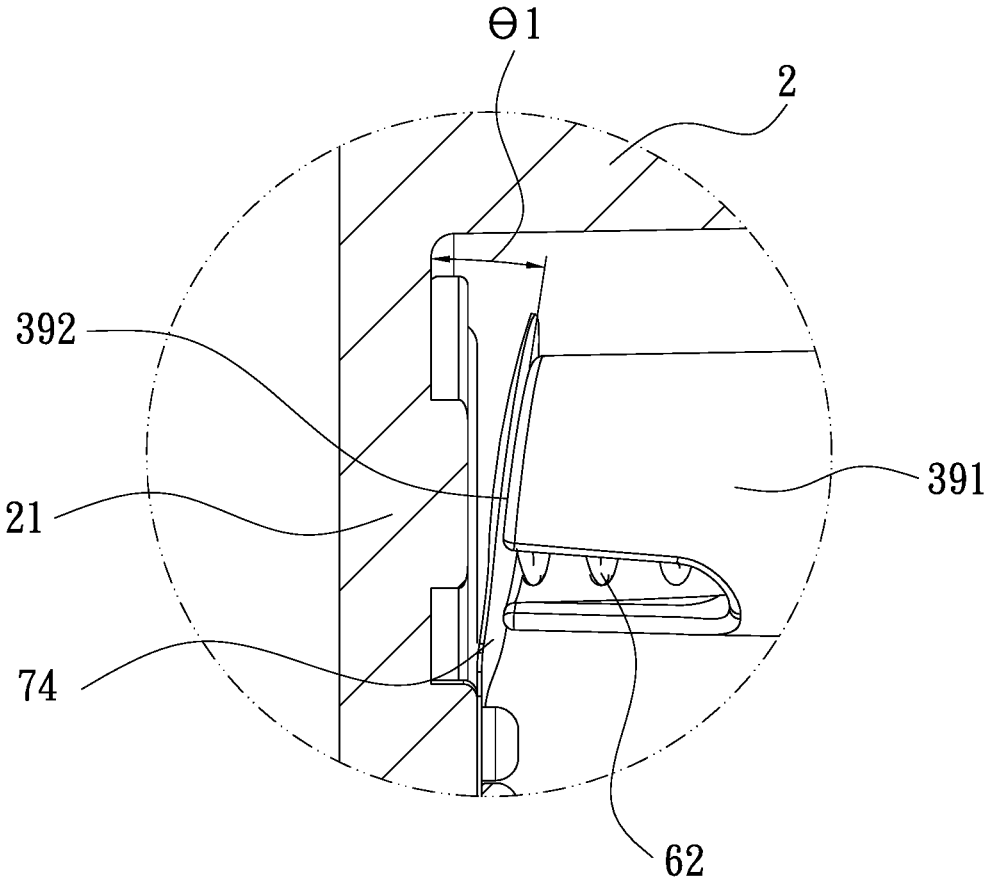
FIG. 15 shows a fragmentary enlarged view of the air compressor of the second embodiment, wherein the branches of the resilient sheet are pushed up by the compressed air in the cylinder.
Figure 16:
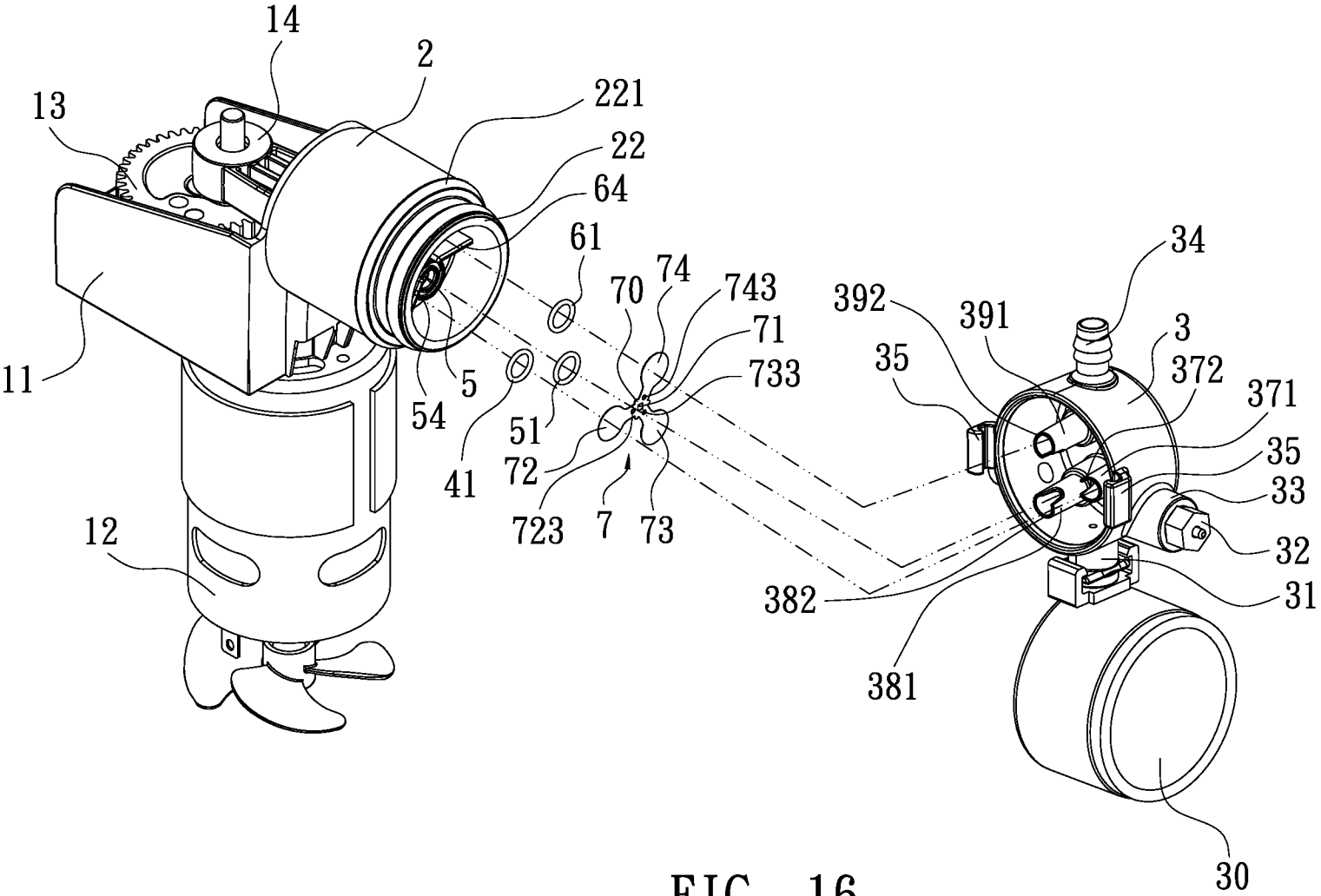
FIG. 16 shows an exploded view of an air compressor according to a third embodiment of the present invention, wherein compression springs are not included.

In the first and second embodiments, as shown in FIGS. 2 and 9, the branches 72, 73, 74 of the resilient sheet 7 are respectively subjected to the compressive forces of the compression springs 42, 52, 62, so that the branches 72, 73, 74 can seal the exit holes 4, 5, 6 more quickly. Nevertheless, in a third embodiment of the air compressor, as shown in FIG. 16, the compression springs 42, 52, 62 employed in the first and second embodiments can be dispensed with; namely, the branches 72, 73, 74 can provide compressive forces by themselves without additional springs to be in tight contact with the O-rings 41, 51, 61, thus sealing the exit holes 4, 5, 6.

As a summary, the air compressor of the present invention has a breakthrough over the prior art in that the top wall 21 of the cylinder 2 defines a plurality of exit holes, which are controlled by a resilient sheet 7 to allow the compressed air produced in the cylinder 2 to quickly enter the inner space 36 of the air storage container 3. In addition, the neck portions 722, 732, 742 of the branches 72, 73, 74 of the resilient sheet 7 are attached to the top wall 21 at separate fixed points, and the air blocking walls 43, 53, 63, 44, 54, 64 can isolate the exit holes 4, 5, 6 from each other at a certain extent, so that when the compressed air produced in the cylinder 2 pushes the branches 72, 73, 74 of the resilient sheet 7 up to open the exit holes 4, 5, 6, the instantaneous high-pressure air that flows through the exit holes 4, 5, 6 can be restrained by the air blocking walls 43, 53, 63, 44, 54, 64, thus preventing the air from interfering with movements of the branches 72, 73, 74 of the resilient sheet 7, so that the piston body 14 can conduct reciprocating motion more smoothly and thus the performance of the air compressor can be increased. These features render the air compressor of the present invention useful and inventive.

I claim:

1. In an air compressor including a main frame for mounting a motor, and a cylinder fitted with a piston body, the motor capable of driving the piston body to conduct reciprocating motion to produce in the cylinder compressed air which can enter an air storage container via a plurality of exit holes defined at a top wall of the cylinder; wherein the improvements comprises: the top wall of the cylinder is provided with the plurality of exit holes having air blocking walls which isolate the exit holes from each other at a certain extent, and the exit holes are regulated by a control mechanism to be opened or closed, the control mechanism including a resilient sheet having a root and a plurality of branches extending from the root and corresponding to the exit holes, whereby when the compressed air produced in the cylinder pushes the branches of the resilient sheet up to open the exit holes, the instantaneous high-pressure air that flows through the exit holes can be restrained by the air blocking walls to prevent the air from interfering with movements of the branches of the resilient sheet, so that the piston body can conduct reciprocating motion more smoothly and thus the performance of the air compressor can be increased.

2. The air compressor of claim 1, wherein the root of the resilient sheet is attached to the top wall at a central point, the branches of the resilient sheet being attached to the top wall respectively at peripheral points close to the central point, whereby each of the branches of the resilient sheet can be moved individually by the compressed air without affecting movements of the other branches, so that the piston body can conduct reciprocating motion more smoothly and thus the performance of the air compressor can be increased.

3. The air compressor of claim 1, wherein the cylinder, including the exit holes and the air blocking walls, is formed integrally with the main frame.

4. The air compressor of claim 1, wherein the air blocking walls are cylindrical walls respectively surrounding the exit holes, each of the cylindrical walls defining an opening facing a central axis of the cylinder.

5. The air compressor of claim 2, wherein the control mechanism further includes a plurality of O-rings and a plurality of compression springs, the O-rings being placed around the exit holes respectively.

6. The air compressor of claim 5, wherein the root is substantially located at a center of the resilient sheet and defines a central positioning hole; the branches extends from the root to appear as a star configuration and includes a first branch, a second branch, and a third branch, the first branch having a first neck portion, which extends from the root and terminates at a first leaf, and defining a first positioning hole at one end of the first neck portion close to the root, the second branch having a second neck portion, which extends from the root and terminates at a second leaf, and defining a second positioning hole at one end of the second neck portion close to the root, the third branch having a third neck portion, which extends from the root and terminates at a third leaf, and defining a third positioning hole at one end of the third neck portion close to the root, the central positioning hole of the root being fitted over a main boss provided at the top wall of the cylinder, the first positioning hole of the first branch being fitted over a first boss provided at the top wall of the cylinder, the second positioning hole of the second branch being fitted over a second boss provided at the top wall of the cylinder, the third positioning hole of the third branch being fitted over a third boss provided at the top wall of the cylinder, the first, second and third leaves being configured to have sizes sufficient for covering the exit holes; whereby the branches of the resilient sheet are in tight contact with the O-rings to seal the exit holes, respectively.

7. The air compressor of claim 6, wherein the first neck portion of the first branch, the second neck portion of the second branch, and the third neck portion of the third branch are respectively fitted through the openings of the air blocking walls; the first leaf of the first branch, the second leaf of the second branch, and the third leaf of the third branch are located within the air blocking walls and in tight contact with the O-rings to seal the exit holes, respectively.

8. The air compressor of claim 6, wherein the air blocking walls are configured to have predetermined heights greater than maximum distances that the branches of the resilient sheet can be pushed up by the compressed air to travel.

9. The air compressor of claim 5, wherein the air blocking walls are planar walls, each planar wall being located between two adjacent exit holes and extending from the top wall towards a central axis of the cylinder, thus defining a plurality of gaps between the planar walls, each gap facing the central axis of the cylinder and corresponding to one of the exit holes, so that the branches of the resilient sheet are capable of fitting over the exit holes and being in tight contact with the O-rings to seal the exit holes, respectively.

10. The air compressor of claim 5, wherein the cylinder has a tubular projection formed on the top wall, the tubular projection provided at its outer surface with a circular flange and defining an annular groove between the circular flange and the top wall, each of the compression springs having one end in contact with one of the branches of the resilient sheet; the air storage container is provided at an outer surface thereof with two coupling means capable of being inserted into the annular groove and engaged with the circular flange of the cylinder.

11. The air compressor of claim 10, wherein the air storage container is provided at an inner surface thereof with a plurality of columns corresponding to the branches of the resilient sheet, each of the columns being formed at its distal end with a limiting surface which is at a predetermined angle to the top wall; each of the compression springs has another end being fitted at the distal end of one of the columns, the compressive forces of the compression springs enabling the branches of the resilient sheet to seal the exit holes, respectively; wherein each of the columns is located at a predetermined height above the corresponding branch of the resilient sheet to limit the movement of the corresponding branch so that the resilient sheet can be prevented from elastic fatigue; the branches of the resilient sheet are capable being in full surface contact with the limiting surfaces of the columns to ensure a stable operation of the branches of the resilient sheet.

12. The air compressor of claim 10, wherein the air storage container is provided at an inner surface thereof with a plurality of hollow columns corresponding to the branches of the resilient sheet, each of the hollow columns being formed at its distal end with a limiting surface which is at a predetermined angle to the top wall; each of the compression springs has another end being fitted into the distal end of one of the hollow columns, the compressive forces of the compression springs enabling the branches of the resilient sheet to seal the exit holes, respectively; wherein each of the hollow columns is located at a predetermined height above the corresponding branch of the resilient sheet to limit the movement of the corresponding branch so that the resilient sheet can be prevented from elastic fatigue; the branches of the resilient sheet are capable being in full surface contact with the limiting surfaces of the hollow columns to ensure a stable operation of the branches.

13. The air compressor of claim 1, wherein the control mechanism further includes a plurality of O-rings being placed around the exit holes respectively, the root of the resilient sheet being attached to the top wall at a central point, the branches of the resilient sheet being attached to the top wall respectively at peripheral points close to the central point, the branches of the resilient sheet having sufficient elastic forces to enable themselves to be in tight contact with the O-rings to seal the exit holes, respectively.

* * * * *